United States Patent [19]

Franks

[11] Patent Number: 4,794,826

[45] Date of Patent: Jan. 3, 1989

[54] HYDRAULIC POWERED WRENCH

[76] Inventor: Neal S. Franks, 18342 Hartlund, Huntington Beach, Calif. 92646

[21] Appl. No.: 822,393

[22] Filed: Jan. 27, 1986

[51] Int. Cl.[4] ..... B25B 13/46

[52] U.S. Cl. ..... 81/57.39; 81/57.4; 81/58.3

[58] Field of Search ..... 81/57.19, 57.36, 57.38, 81/57.39, 57.44, 58.3, 58.4, 57.24, 57.35, 57.4; 91/462, 466; 73/761; 403/326; 285/305, 276

[56] References Cited

U.S. PATENT DOCUMENTS

| | | | |
|---|---|---|---|
| 1,662,543 | 3/1928 | Smith et al. | 81/57.24 |
| 2,774,336 | 12/1956 | Geyer | 91/466 X |
| 3,087,307 | 4/1963 | Faisandier | 91/466 X |
| 4,281,601 | 8/1981 | Overman | 403/326 X |
| 4,294,122 | 10/1981 | Couchman | 73/761 |
| 4,336,727 | 6/1982 | Junkers | 81/57.39 |
| 4,498,874 | 2/1985 | Pichl | 285/305 X |
| 4,509,407 | 4/1985 | Balaskas | 91/466 |

FOREIGN PATENT DOCUMENTS

| | | | |
|---|---|---|---|
| 2631852 | 1/1978 | Fed. Rep. of Germany | 81/57.39 |

*Primary Examiner*—Debra S. Meislin

[57] ABSTRACT

A hydraulic powered wrench for fastening and unfastening a bolt, or the like, is presented. A wrench comprises a control valve capable of coupling hydraulic fluid to either of two hydraulic conduits, one on each side of a hydraulic piston within a hydraulic cylinder so that the control valve can move the piston linearly. A double ended socket, each end comprising a bolt receiving surface is utilized. Only a single positive drive is coupled to an external female spline and is coupled to rotate the socket in one direction only. A cylinder rod is coupled to and moved linearly by the piston and is pivotally connected to drive rotationally the drive arm via a female clevis wherein the drive arm is coupled to rotate the ratchet thru the positive drive which in turn is coupled to the socket.

3 Claims, 2 Drawing Sheets

HYDRAULIC POWERED WRENCH

BACKGROUND OF THE INVENTION

1. Field of the Invention

The present invention relates to hydraulic powered wrenches particularly those used on ships which drill for oil.

2. Description of the Prior Art

Any table of element quantities can be referred to to prove that the total amount of hydrocarbons in the lithosphere of the earth is more than one billion times as much as the human race uses annually. The hydrocarbons come in three main types, high molecular weight which are gases such as natural gas, although the gases may be dissolved, and intermediate weight molecules which comprise petroleum, also referred to herein as oil. While the total amount of hydrocarbons is enormous, it is economic at present only to remove those which can be removed least expensively. Various natural processes have consentrated petroleum in various pressurized and not pressurized volumes. Oil drilling comprises drilling a hole down to a volume where the oil exists either pressurized so that it comes up without pumping or less pressurized so that pumping is necessary to bring the oil to the surface.

Economically, it makes sense to drill for the oil which is cheapest to bring to the surface first then leave the balance of the oil until later when a shortage has driven up the price or when technology has advanced sufficiently so that the cost is no longer as high. For this reason, the land surface of the United States has been drilled a substantial number of times and it is believed that substantially all of the larger concentrations have been tapped. After the larger concentrations in convenient locations are tapped, the oil industry has two alternatives, it can tap lesser concentrations in convenient locations or greater concentrations in less convenient locations. It does both.

The U.S. Geological Survey has estimated that more than 100 billion tons of oil will eventually be burned beneath the U.S. continental shelf. Oil drilling ships and platforms have been designed and have been in operation for years to attempt to tap this vast potential source of petroleum. The cost of operation of ships may exceed $100,000 a day and the cost of oil drilling platforms is also high. Accordingly, any down time, even of a few minutes, may cost thousands of dollars. Because of this, even a small improvement in the operation of the oil drilling ships is economically worthwhile, even though cost may appear to be very high for only a slight improvement.

When one is drilling perhaps more than a mile beneath the surface, some of the equipment at the surface is relatively large. Bolts, for example, may be very large and tightened under pressures far beyond hand strength. For this reason, hydraulic wrenches are utilitzed to tighten and loosen bolts and other similar assemblies. Hydraulic fluid under pressure is available on these ships, and the prior art as well as the present invention makes use of this hydraulic fluid to drive hydraulic wrenches.

The prior art hydraulic wrenches use two radial ratchets one right hand and one left hand, which alternatively drive a square standard socket drive. These wrenches must be disassembled and reassembled with additional parts weighing 10 to 15 pounds to change directions. What is needed but not found in the prior art is a hydraulic wrench which cannot break without the use of these special tools which the prior art uses for installation or removal in order to change direction of the wrench. In addition, with the prior art, there is the problem of making and stocking hundreds of sizes of retaining rings which rings are used on prior art hydraulic wrenches. The prior art has a requirement for access to the end of the end of the hole. This in turn makes necessary a requirement that the groove be relatively close to the end. The present invention eliminates this requirement since it utilizes a coiled retaining ring which is installed tangent to the shaft and may be located at any point along its length. The prior art includes a problem of holding a shaft and preventing it from moving axially in either direction. The present invention overcomes this difficulty by locating the part of the annular groove in the hole and part on the shaft. An installed coiled retaining then transgresses the shaft-/hole interface and holds both parts relative to each other.

Prior art problems solved by a wrench according to the present design, not counting the retaining ring, include the avoiding of transverse loads and the consequential moments which are avoided by positioning the reaction arm in a wrench according to the present invention in the plane of the fastener drive head. A splined sleeve transmits torque of the drive arm to the driven cylinder.

This assembly-reassembly is avoided by providing only one single radial ratchet to drive a socket which has two surfaces mating with a bolt, so that disassembly and reassembly is not necessary, to change directions one merely uses the other surface of the socket. In addition, minor problems are cured such as the problem of not being able to locate the power supply and control valving in close proximities to the wrench which problem is avoided in the present invention by placing at least one control valve on the torque wrench assembly, for use by the wrench operator, and utilizing a cylinder which is large enough so that hydraulic power already widely distributed on a drilling ship or platform can be used directly to provide the force needed to torque the wrench. This capability of utilizing lower pressure also means that parts do not wear out as quickly as on the higher pressure prior art wrenches.

SUMMARY OF THE INVENTION

A two ended socket reversible powered wrench is presented. The wrench is capable of coupling to a reaction surface and receiving power from an outside source. The wrench comprises means to receive power from an outside source. It also includes means to convert power to torque. It further includes means to apply torque to a positive drive driven doubled headed unidirectional socket having one end rotating about an axis in a clockwise direction and an opposite end rotating about the same axis in a counterclockwise direction when the socket rotates. While this may seem like a contradiction in terms, when one rotates a cylinder, one end when viewed from the surface rotates clockwise while the other end rotates counterclockwise as viewed from that other end.

The power from the outside source may be electrical but in most cases is hydraulic. Air pressure may also be used. If hydraulic power is used, it is received via an inlet conduit and coupled to a three way valve having the positions of neutral, tightening, and loosening.

Venting means vent hydraulic pressure when the valve is in the neutral position.

The means to convert power to torque comprise a hydraulic cylinder having a hydraulic piston therein. One end of the cylinder on one end of the piston is coupled to receive hydraulic power when the valve is in the tightening position. The same end of the cylinder is coupled to receive power from the valve when the valve is in the loosening position. Power from the valve forces the piston away from the end of the cylinder receiving power.

Coupling means couple the piston to linear-to-rotational-motion converting means.

In a first example, the socket includes an interior surface defining on each end of the socket a mating female hex capable of coupling to a hex bolt head. The wrench is controlled by an articulated control handle which is spring loaded to return to the neutral position when not moved to either of the other two positions and which control handle controls the position of the valve.

The piston is coupled to and linearly moves a piston rod which in turn is pivotally connected to a rotational drive arm via a female clevis coupled to the drive arm by a clevis pin to form the means to convert power from the piston from linear to rotational motion to rotate the socket.

The drive arm has an exterior surface defining drive teeth which rotate about an axis and the drive teeth are coupled in a positive drive arrangement to driven teeth coupled to the socket which is disposed to rotate about the same axis the driving teeth rotate about. The interior surface of the drive arm on the end opposite to the drive teeth defines a clevis pin hole which mates with and is controlled by the outer surface of the clevis pin. The other surface of the various elements define reliefs at selected points. A counter balance weldment balances the wrench. The angle between a longitudinal axis about which the drive arm is generally disposed and the direction of linear motion of the piston is between 70° and 110°.

A sound pulse generator is coupled to transmit sound longitudinally through a bolt being tightened by the wrench and receive sound reflected from the opposite end of the bolt and is capable of measuring the distance in time taken by the sound to pass through the bolt to measure elongation of the bolt and display a number which is a function of the elongation of the bolt on a gauge having a readout. Accordingly, each bolt being tightened may be elongated to substantially the same extent during tightening since elongation is a good measure of the amount of loading of a bolt and said number is displayed constantly during tightening and loosening of bolts.

The surface of the socket defines a groove at the interface with a reaction arm. There are two reaction arms. An upper reaction arm is used in loosening a bolt and a lower reaction arm is used in tightening a bolt and each reaction arm surface defines a reaction arm groove. The socket surface defines an upper socket groove at the interface with the upper reaction arm groove and the socket surface defines a lower socket groove at the interface with the lower reaction arm groove. A coiled cable transgresses the upper socket groove at the interface with the upper reaction arm groove to prevent upper reaction arm axial movement and a second coiled cable transgresses the lower socket groove at the interface with the lower reaction arm groove to prevent lower reaction arm axial movement.

In one example, the surface of the socket defines external driven spline driven by spline defined by the exterior surface of the ratchet. In a second example the exterior surface of the socket defines a regular polygon such as a square, hexagon or octagon driven by a regular polygon of substantially the same dimensions defined by the interior surface of the ratchet.

A feature of the invention may be used in applications other than a wrench to prevent a rotating cylinder from moving linearly along its axis a substantial distance. It comprises at least one circumferential groove defined by the surface of the rotating cylinder. A housing adjacent the cylinder and including coupling means coupled a cable, which cable transgresses the groove defined by the surface of the cylinder and prevents the cylinder form moving a substantial distance linearly along the axis of the cylinder from the location of the coupling means on the housing.

DRAWING DESCRIPTION

Reference should be made at this time to the following detailed description which should be read in conjunction with the following drawings of which:

FIG. 5 illustrates a readout illustrating elongation measured by the circuitry of FIG. 5;

DETAILED DESCRIPTION

Figure 7:
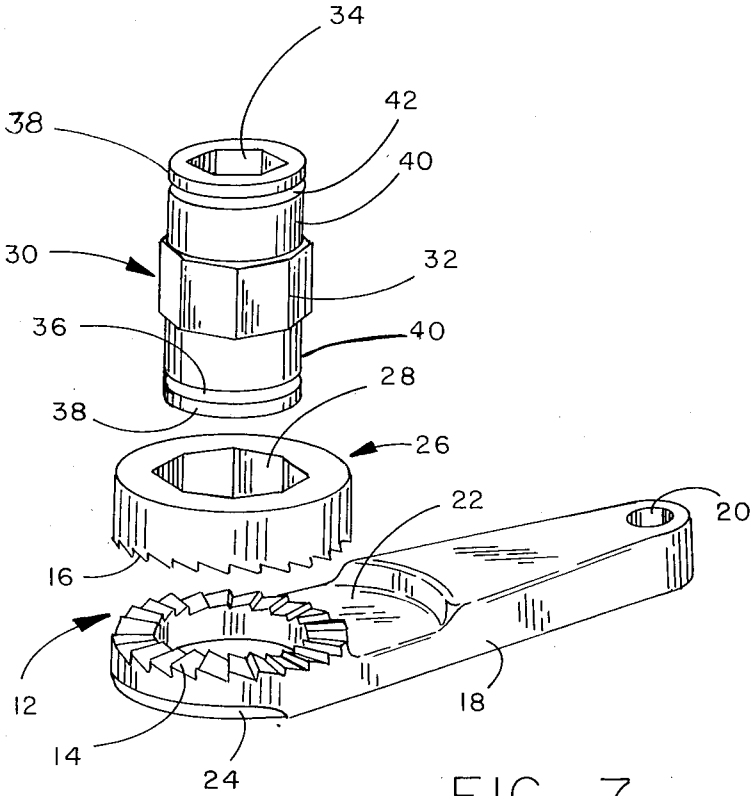
FIG. 7 illustrates a second example of the invention utilizing in place of the spline of FIG. 6 a regular male polygon on the socket mating with a substantially identical size and shape regular female polygon on a ratchet.

Reference should be made at this time to FIGS. 1–6 which illustrate an example of the invention 10 referred to as a hydraulic powered wrench 10 or a wrench 10. FIG. 7 illustrates a second example of that part of the invention 10 illustrated in FIG. 6.

The wrench 10 is designed for use with hydraulic power in areas such as on oil drilling rigs (not shown) which have hydraulic power outlets (not shown). The hydraulic power outlet in the area where the wrench 10 is to be used couples hydraulic power to conduit 84, then to valve 70. In most cases, the valve 70 is a three way valve. In the static position, the valve 70 is blocking incoming hydraulic pressure from the conduit 84 and venting both ends of hydraulic cylinder 68 via piston retraction hydraulic hose 76 and piston extension hydraulic hose 78.

Figure 1:
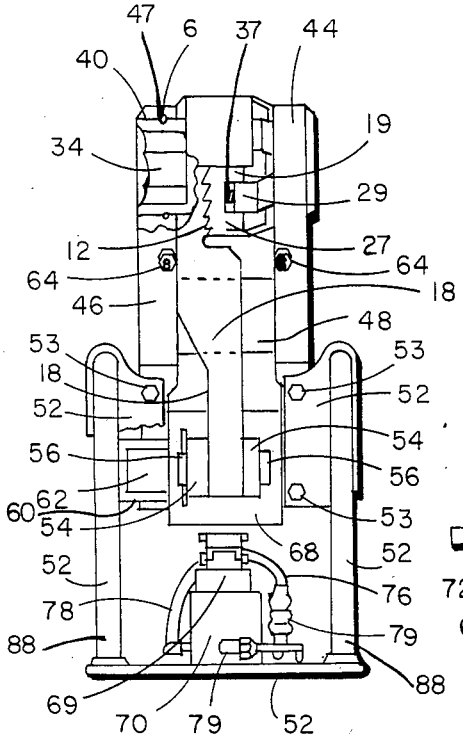
FIG. 1 is an end view of a wrench according to the present invention.
Figure 2:
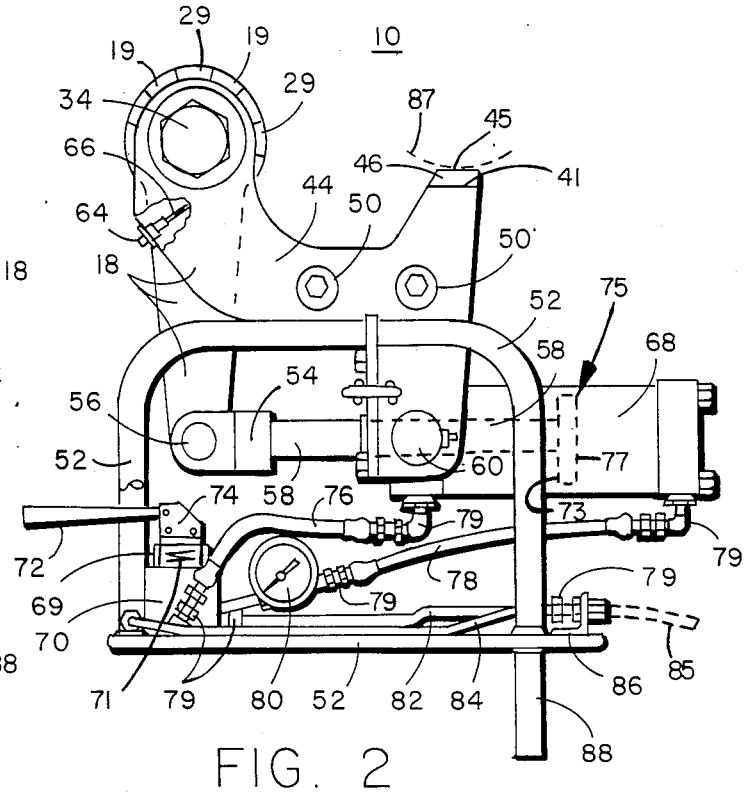
FIG. 2 is a plan view of the wrench of FIG. 1.
Figure 3:
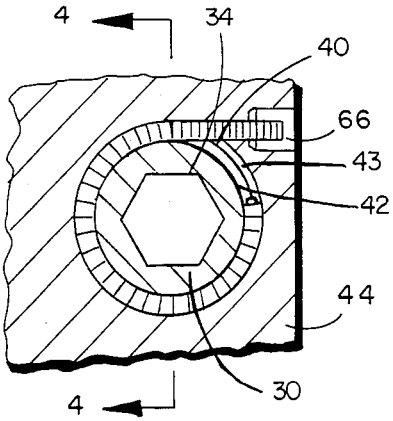
FIG. 3 illustrates a cable utilized to prevent linear motion.
Figure 4:
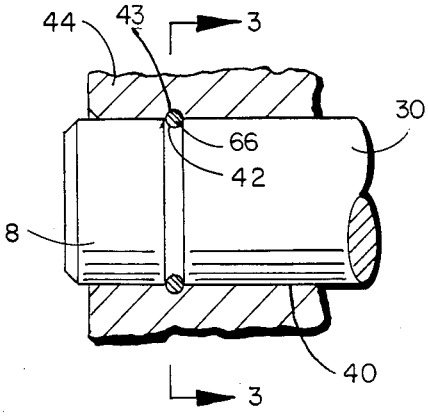
FIG. 4 is another view of the cable of FIG. 3 as utilized.

To apply the wrench 10 to a bolt, (not shown) bolt head mating female hex 34 is coupled to a bolt head (not shown). To tighten the bolt which would be underneath bolt head mating female hex 34 as shown in FIG. 2, hex 34 is rotated clockwise. Reaction surface 45 contacts an adjacent surface (not shown) to absorb the reaction moment. The wrench 10 is maneuvered and positioned as desired by wrench manipulation handles 88.

To tighten a bolt (not shown), the operator presses down articulated control handle 72 which allows fluid to flow through hose 78 to the back side 77 of piston 75 forcing piston 75 to move left on FIG. 2 linearly. Piston rod 58 is coupled to and moved linearly by piston 75 and is pivotally connected to drive rotationally drive arm 18 via a female clevis 54 coupled to the drive arm 18 by clevis pin 56. The drive arm 18 is coupled to rotate a ratchet 27 (on FIG. 6) through a positive drive 12 which in turn is coupled to a socket 31 via ratchet spline 19 which in turn is coupled to and drives socket spline 29.

When the operator (not shown) pulls up on handle 72, hydraulic pressure is caused to flow through control valve 70 and piston retraction hydraulic hose 76 to piston front side 73 causing piston 75 to move linearly right on FIG. 2. This reverses the previously described action, causing piston rod 58 to pull female clevis 54 to the right causing drive arm 18 to be pulled to the right by clevis pin 56 rotating drive arm 18 counterclockwise.

Friction in bolt threads (not shown) hold bolt head mating female hex 34 and socket 31 substantially stationary. Socket 31 holds ratchet 27 substantially stationary via ratchet spline 19 and socket spline 29. Unidirectional positive drive 12 allows drive arm 18 to rotate counterclockwise while ratchet 27 remains substantially rotationally stationary. Compression spring 37 axially loads ratchet 27 therein forcing driven teeth 16 into driving teeth 14. Compression spring 37 comprises in the present example six springs and may comprise varying numbers of individual springs in different examples of the invention.

Torque gauge 80 displays the degree of tightening by sensing hydraulic pressure in piston extension hydraulic hose 78. Fittings 79 couple the various hoses to selected locations.

Hydraulic cylinder 68 is allowed to pivot trunion 62 which mates with trunion cap 60 on both sides of cylinder 68.

Bolts 50 go through upper reaction arm 44, spacer 48, and thread into lower reaction arm 46 to hold these parts together.

Coiled cable 66 transgresses upper socket groove 42 at the interface with upper reaction arm groove 43 to prevent upper reaction arm 44 from axial movement. Another coiled cable 67 transgresses lower socket groove 36 and lower reaction arm groove 47 and axially holds them together. Either coiled cable 66, 67 may be inserted or removed by removing the associated grease fitting 64. Coiled cable 67 operates similarly to the way coiled cable 66 is shown operating in FIGS. 3 and 4.

Counter balance weldment 52 is utilized to balance the wrench 10 which otherwise would have too much weight on one side. The weldment 52 greatly facilitates handling of the wrench 10.

Figure 6:
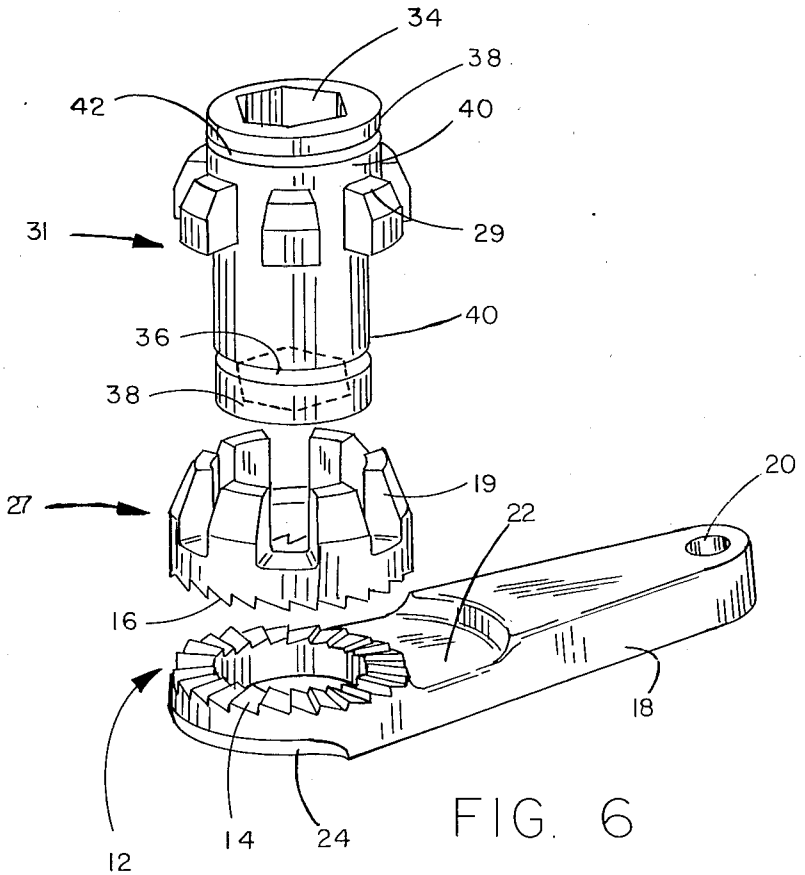
FIG. 6 illustrates a first example of a wrench utilizing spline.

Reference should be made at this time to FIGS. 6 and 7 which illustrate two different examples of the invention 10 in part. FIG. 6 illustrates an example utilizing a spline ratchet 27 with ratchet spline 19 and socket spline 29.

FIG. 7 illustrates one of the alternative examples. In place of socket spline 29, an octagon male socket 30 is used. Of course, a male socket having some number of sides 32 other than eight could be utilized and would be within the scope of the present invention. An octagon female socket 28 mates with male socket 30 in place of ratchet spline 19 which is the comparable part in FIG. 6.

Clevis pin hole 20 defines a surface which mates with and is controlled by the outer surface of clevis pin 56 which is rotated by movement of piston 75. Reliefs 22 and 24 facilitate manufacture of the driving teeth 14 and lighten the wrench 10. The reliefs 22, 24 may be of any selected useful shape.

Figure 5:
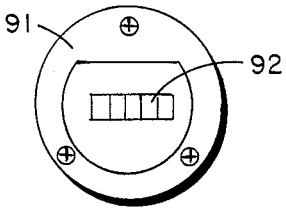
FIG. 5 illustrates an elongation measuring component of the invention.
Figure 5:
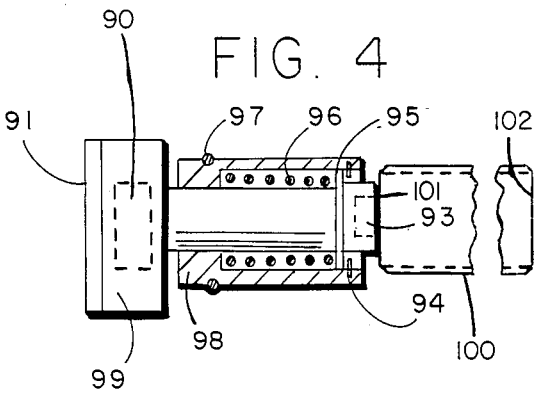

Reference should be made at this time to FIGS. 5 and 51 which illustrate the use of a sound pulse generator 90 to secure uniform tightening of bolts (not shown). The sound pulse generator 90 generates an electronic signal which is sent to a transducer 93 and causes transducer 93 to generate a sound pulse. The sound pulse generated by transducer 93 is transmitted to the top end 101 of a bolt 100 having its top surface adjacent transducer 93. The sound pulse goes through the bolt 100 from the top end 101 to the bottom end 102 from which it is reflected back up through the bolt 100 and the top end 101 to the generator 90 which receives the reflected sound pulse. The generator 90 generates electronics signals. Krautkramer-Branson Model DMX1 sound pulse generator or the equivalent has the necessary characteristics to measure the time difference between generation of the initial pulse and return of the sound from bottom end 102 of bolt 100 and convert the time difference into initial bolt 100 length. During bolt 100 tightening, bolt 100 stretches and the elongation measured by subsequent sound pulses can be compared to determine change in bolt 100 length and displayed on gauge 91 readout 92. When the elongation displayed on readout 92 is substantially identical to prior readings, the degree of bolt loading is also substantially identical within the scope of precision required for application to which the wrench 10 is utilized.

The same amount of torque does not tighten different substantially identical bolts to the same precise degree because of minor differences in the bolts and their relation to the mating thread surfaces. One surface may be dirty, have sand, or differ in a variety of ways. With the tremendous forces and pressures in various applications of the wrench 10, a more precise method of ensuring uniform loading is necessary and the use of the sound pulse generator 90 and associated elements provides the necessary greater precision.

Various bolts 53 hold the weldment 52 to the wrench 10. Necessary bracing such as hydraulic line bracket 86 ensures that hydraulic fluid lines 82, 84 do not flex more than desired. Socket end 38 and bearing surface 40 interface with upper reaction arm 44 and lower reaction arm 46 as bearing surfaces. Handle pivot 74 facilitates articulation of handle 72 and application of control signals from handle 72.

Control valve 70 may be placed in three different operational modes or positions by handle 72. As shown in FIG. 2 with handle 72 horizontal, control valve 70 is in the neutral position with both sides of cylinder 68 and both sides 73, 77 of piston 75 vented to atmospheric pressure via hydraulic hoses 76, 78 and hydraulic fluid return line 82. This is an important advantage because it facilitates removal of the wrench 10 from a bolt. If there were no venting, reaction surface 45 would still be pushing against an adjacent surface 87 with a force of many thousands of pounds making removal of the wrench 10 impossible under practically all circumstances and difficult where not impossible.

Lifting handle 72 retracts the piston 75 by causing valve 70 to switch to a retract mode in which hydraulic pressure flows through hose 76 to side 73 of piston 75 and hydraulic fluid flows away from that portion of the cylinder 68. When the handle 72 is lowered, control valve 70 causes hydraulic fluid to flow through hose 78 to the side of the cylinder 68 adjacent piston side 77 and away from the side of the cylinder 68 adjacent piston side 73 via hose 76.

Prior art wrenches must be disassembled to unloosen bolts after tightening bolts. As stated previously in Background of the Invention, many millions of dollars can be saved annually by a wrench which need not be disassembled because of saving of expensive down time on drilling rigs, etc. If the present wrench 10 has been used to tighten a bolt and it is then desired to loosen the same bolt or a different bolt, the following procedure is followed:

The operator releases handle 72. Spring 71 in handle spring return housing 69 causes handle 72 to return to the neutral horizontal position thereby opening both ends of the cylinder 68 to atmospheric pressure. The wrench 10 is removed from the bolt. Socket 31 as best shown in FIG. 6 is double ended. the opposite end of the wrench 10 has been placed on the bolt. The operator then appropriately controls the handle 72 by lifting it. The piston 75 remains in approximately the same position and the pressure inside the cylinder 68 remains approximately the same as when tightening, and the same end of the socket 31 used to tighten the bolt still rotates in the same direction, but the opposite end of the socket 31 is rotating in the opposite direction in relation to the bolt because of being the opposite end of the socket 31 and rotating in the apparent opposite direction when the socket 31 is rotated with wrench 10 to place the opposite end on the bolt.

FIG. 2 illustrates via dotted lines a hydraulic source 85 coupled to furnish hydraulic pressure to hydraulic fluid supply line 84 of the wrench 10. A reaction surface may be of any shape on a rig (not shown) or other area where the wrench 10 is used, but is shown as a curved line 87 on FIG. 2.

Reactions arms 44, 46 act as follows:

During tightening, lower reaction arm 46 is in or near the plane of the bolt head and contacts adjacent surfaces or surface represented by numeral 87 also in the plane of the bolt head on FIG. 2. Force is transmitted to the entire wrench 10 in reaction to rotation of the bolt. Most reaction forces remain in the plane of the bolt head rather than causing twisting ad binding in the wrench 10 during tightening. Surface 45 of the lower reaction arm 46 comes in contact with surface 87 which absorbs the reaction force.

During loosening, the upper reaction arm 44 acts in a similar manner and surface 41 comes in contact with surface 87 which absorbs the reaction force.

A two ended socket reversible powered wrench 10 according to the present invention capable of coupling to a reaction surface and receiving power from an outside source may be powered by either air, electricity, or other means known to the prior art as well as the hydraulic powered wrench 10 described in the previous example. The means to receive power from the outside source and means to convert power to torque will vary from those described previously herein if electricity or air or some other source of power are used, but are well known to the prior art. The same means to apply torque to a double headed unidirectional socket 30 driven by a positive drive wherein the driven socket is rotated about its axis and opposite ends of the socket rotate the workpiece clockwise or counterclockwise depending on which end of the double-headed socket is engaged with the workpiece.

During tightening or loosening gauge 91 is inserted through the upper end of bolt head mating female hex 34 until transducer 93 contacts bolt top end 101. Spring 96 is manually compressed thereby holding transducer 93 against bolt top end 101. Body 98 is adjacent to the inside surface of socket 30 and retaining ring 97 is compressed radially and friction between the remaining ring and the inside surface of socket 30 holds the gauge in place and maintains the spring load on the transducer. Retaining ring 94 limits axial movment of collar 95.

A particular example of the invention has been disclosed herein. Other examples will be obvious to those skilled in the prior art. The invention is limited only by the following claims.

I claim:

1. A two ended socket reversible powered wrench capable of coupling to a reaction surface and receiving power from an outside source and comprising:

means to receive power from an outside power source;

means to convert power to torque;

means to apply torque to a double headed unidirectional socket driven by a positive drive wherein the driven socket is rotated about its axis and opposite ends of the socket rotate the workpiece clockwise or counter-clockwise depending on which end of the double headed socket is engaged with the workpiece;

wherein the power from the outside source is hydraulic power, the means to receive hydraulic power includes an inlet conduit coupled to a three way valve having the positions of neutral, applying torque, and ratcheting;

venting means venting hydraulic pressure when the valve is in the neutral position;

the means to convert power to torque comprises a hydraulic cylinder having a hydraulic piston therein, one end of the cylinder coupled to the means to receive hydraulic power on one end of the piston when the valve is in the applying torque position and power from the valve forcing the piston away from the end of the cylinder receiving power;

coupling means coupling the piston to linear-to-rotational-motion converting means which in turn is coupled to the socket to rotate the socket;

wherien the socket includes an interior surface defining on each end of the socket a mating female hex capable of coupling to a hex bolt head, the valve including an articulated control handle which is spring loaded to return to the neutral position when not moved to either of the other two positions and which control handle controls the position of the valve;

the piston is coupled to and linearly moves a piston rod which in turn is pivotally connected to a rotational drive arm via a female clevis coupled to the drive arm by a clevis pin to form the linear-to-rotational motion converting means to rotate the socket;

the drive arm has an exterior surface defining drive teeth which rotate about an axis and the drive teeth are coupled in a ratchet arrangement to driven teeth coupled to the socket which is disposed to rotate about the same axis the driving teeth rotate about;

an interior surface of the drive arm on an end opposite to the drive teeth defines a clevis pin hole which mates with and is controlled by an outer surface of the clevis pin and;

the angle between a longitudinal axis about which the drive arm is generally disposed and the direction of linear motion of the piston is between 70 and 110 degrees;

wherein there are two reaction arms, including an upper reaction arm used in loosening a bolt and a lower reaction arm used in tightening a bolt and each reaction arm defines a reaction arm groove, the socket including a surface defining an upper socket groove adjacent to the upper reaction arm groove and a lower socket groove adjacent to the lower reaction arm groove, a coiled cable extending within the grooves of the socket and the reaction arms to prevent axial movement relative to the socket.

2. The invention of claim 1 wherein the surface of the socket defines an external driven spline driven by a spline defined by the exterior surface of the ratchet.

3. The invention of claim 1 wherein the exterior surface of the socket defines a regular polygon driven by a regular polygon of substantially the same dimensions defined by the interior surface of the ratchet.

* * * * *